US011815285B2

(12) United States Patent
Doat et al.

(10) Patent No.: US 11,815,285 B2
(45) Date of Patent: Nov. 14, 2023

(54) ACOUSTIC RESONATOR FOR FAN

(71) Applicant: VOLVO TRUCK CORPORATION, Gothenburg (SE)

(72) Inventors: Bertrand Doat, Villette de Vienne (FR); Alexandre Cano, Saint Priest (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 99 days.

(21) Appl. No.: 17/451,091

(22) Filed: Oct. 15, 2021

(65) Prior Publication Data

US 2022/0120469 A1 Apr. 21, 2022

(30) Foreign Application Priority Data

Oct. 19, 2020 (EP) ..... 20202545

(51) Int. Cl.
*F24F 13/24* (2006.01)
*G10K 11/16* (2006.01)
*G10K 11/172* (2006.01)

(52) U.S. Cl.
CPC ..... *F24F 13/24* (2013.01); *G10K 11/161* (2013.01); *G10K 11/172* (2013.01)

(58) Field of Classification Search
CPC ..... G10K 11/161; G10K 11/172; F24F 13/24; F24F 2013/245; F04D 29/665; F01N 1/12; F01N 1/16; F01N 1/161; F01N 1/163; F01N 1/165; F01N 1/166; F01N 2470/24
USPC ..... 181/216, 224, 225, 226, 278, 279, 241
See application file for complete search history.

(56) References Cited

U.S. PATENT DOCUMENTS

| | | | | |
|---|---|---|---|---|
| 3,888,331 | A | 6/1975 | Wang | |
| 3,948,349 | A | 4/1976 | Bychinsky | |
| 4,168,948 | A * | 9/1979 | Okamoto | F23D 11/001 431/114 |
| 4,871,294 | A | 10/1989 | Ivanov et al. | |
| 6,364,055 | B1 | 4/2002 | Purdy | |
| 2003/0183446 | A1 | 10/2003 | Shah et al. | |
| 2005/0205351 | A1* | 9/2005 | D'Angelo | F02K 3/06 181/216 |

(Continued)

FOREIGN PATENT DOCUMENTS

| | | | | |
|---|---|---|---|---|
| DE | 102018103175 | B3 | 3/2019 | |
| EP | 2426427 | A2 * | 3/2012 | F16L 55/02772 |
| WO | 2020028838 | A1 | 2/2020 | |

OTHER PUBLICATIONS

Wikipedia page for "Acoustic Resonance," Jul. 29, 2016 (Year: 2016).*

*Primary Examiner* — Jeremy A Luks
(74) *Attorney, Agent, or Firm* — Venable LLP; Jeffri A. Kaminski

(57) ABSTRACT

An acoustic resonator for a fan includes an annular shape internal volume defining by a housing, housing and internal volume are coaxial relative to the longitudinal axle of the acoustic resonator, internal volume comprises at least one coaxial helical channel, the at least one coaxial channel comprise an inlet and outlet corresponding to inlet and outlet of the acoustic resonator characterized in that the acoustic resonator comprises adjusting means provide for modified the length between inlet and outlet of the acoustic resonator according an acoustic frequency to lower noise.

7 Claims, 2 Drawing Sheets

(56) References Cited

U.S. PATENT DOCUMENTS

| | | | | |
|---|---|---|---|---|
| 2007/0023230 | A1* | 2/2007 | Nakayama | F02M 35/1255 181/276 |
| 2018/0108339 | A1 | 4/2018 | Young et al. | |
| 2020/0248660 | A1 | 8/2020 | Guerry et al. | |

* cited by examiner

ACOUSTIC RESONATOR FOR FAN

TECHNICAL FIELD

The invention concerns the reduction of fan noise and more particularly, the use of an acoustic resonator.

BACKGROUND

Electric or hybrid vehicles use increasingly efficient batteries and electric motors that require optimal operating conditions. Thus, the cooling of electric motors and/or batteries is becoming a major concern in the development of electric or hybrid vehicles. Unlike a vehicle with a conventional internal combustion engine, the need for cooling is both greater and not necessarily during periods when the vehicle is running. It is therefore not possible to use engine speed to drive the cooling system.

In an electric or hybrid vehicle, the electric motor(s) and/or batteries are cooled by means of a heat exchanger (typically air-to-air or air-to-water) equipped with a fan to generate airflow. In a cooling application the fan speed can vary for example between 2500 and 5000 rpm depending on the cooling demand.

The rotation of the fan generates an acoustic wave that can at certain points of fan operation generate audible noise that is unpleasant for the vehicle operator.

It is known from the earlier art of helical acoustic resonators to reduce the acoustic level of a fan. Acoustic helical resonator manipulates an existing incident acoustic wave, created by fan flow, to generate a phase shifted acoustic wave. At resonator outlet, the recombination of incident and phase shifted acoustic waves create destructive interferences that significantly reduce overall noise radiation. As acoustic wavelength is fan rotation speed dependent, an helical acoustic resonator with a fixed geometry can only attenuate noise from fan with invariant rotation speed.

SUMMARY

An first object of the invention is to provide an acoustic resonator, which is able to reduce noise of more than one rotation speed of a fan associated with the acoustic resonator.

The object is achieved by an acoustic resonator for a fan comprising an annular shape internal volume defining by a housing, housing and internal volume are coaxial relative to the longitudinal axle of the acoustic resonator, internal volume comprises at least one coaxial helical channel, the at least one coaxial channel comprise an inlet and outlet corresponding to inlet and outlet of the acoustic resonator characterized in that the acoustic resonator comprises adjusting means provide for modified the length between inlet and outlet of the acoustic resonator according an acoustic frequency to lower noise.

By the provision of an acoustic resonator which comprises adjusting means modifying the length between inlet and outlet of the acoustic resonator it is possible reduce the noise for several acoustic frequency.

According to one embodiment, each coaxial channel comprises a flexible wall formed between external and internal wall. This flexible wall insure a constant length of each coaxial channel.

According to a further embodiment, adjusting means comprises a upstream section of the housing and a downstream section of the housing, the upstream and downstream section of the housing are arranged to slide one into the other.

According to a further embodiment, adjusting means comprises an actuator to move upstream and downstream section relative to each other.

According to a further embodiment, sliding movement of the upstream and downstream section relative to each other is a translation parallel to longitudinal axle of the acoustic resonator.

According to a further embodiment, sliding movement of the upstream and downstream section relative to each other is a rotation around the longitudinal axle of the acoustic resonator.

Another object of the invention is to provide a system for reduction of fan noise comprising a fan and an acoustic resonator according to the first object.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
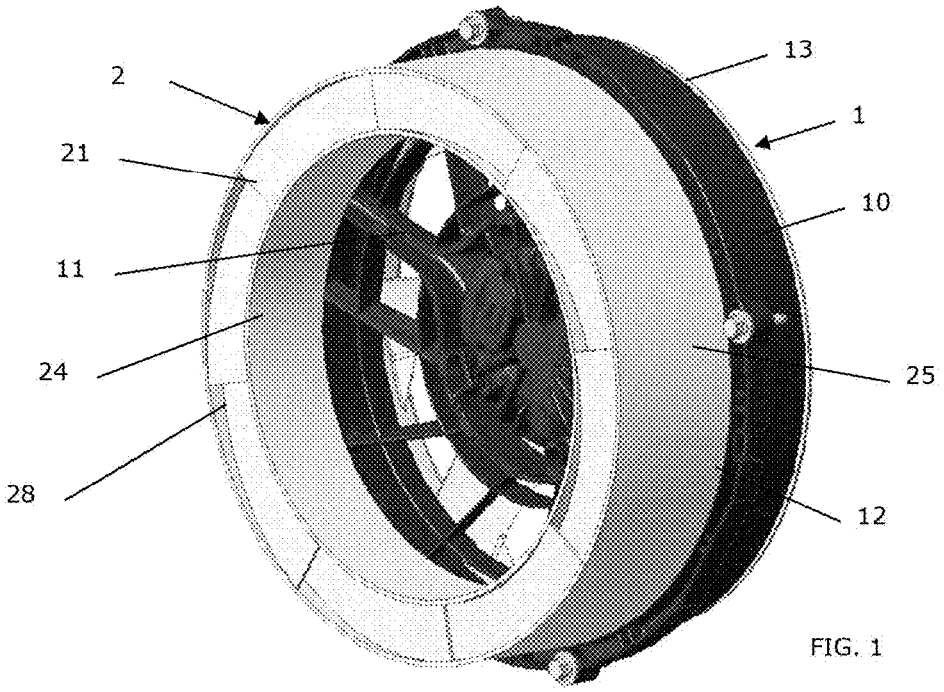
FIG. 1 is a perspective view of a fan equipped with the resonator according to the invention.
Figure 2:
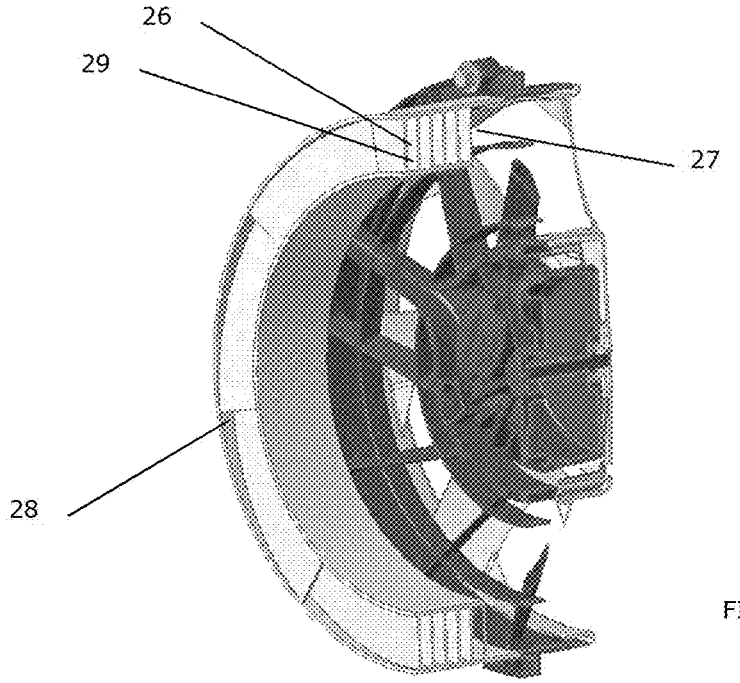
FIG. 2 is a perspective and longitudinal sectional view of a fan equipped with the resonator according to the invention.

FIG. 1 shows a system comprising a fan 1 equipped with an acoustic resonator 2 according to the invention.

In a manner known per se, the fan 1 comprises a housing 10 of substantially annular shape in which is mounted a wheel 14 comprising a plurality of blades 11. The wheel 14 is driven in rotation by a motor (not shown), for example mounted on the side. 'inside the wheel 14.

The housing 10 comprises an upstream face 13 mounted on an element to be cooled and a downstream face 12 on which the acoustic resonator 2 according to the invention is mounted. The air flow generated by the fan 1 flows from the upstream face 13 to the downstream face 12 through the housing 10.

Also in a manner known per se, the fundamental acoustic frequency of the blade passing (BPf) of a fan corresponds to the equation:

$$f=R/60\times b$$

With:

f, the frequency in Hertz

R, the fan speed in revolutions/minute b, the number of blades

The wavelength λ of the wave thus created is equal to $$c/f$$

with f, the frequency in Hertz c, the propagation speed of the acoustic wave in the medium (here, 340 m/s in air at 15° C. at sea level)

Thus, it is understood that the acoustic wave generated by a fan depends on the speed of rotation and the number of blades.

The principle of noise reduction according to the invention consists of forcing part of the acoustic wave of the fan to travel a distance greater than what it would have traveled if it had passed axially through the interior of the resonator. The acoustic wave which has passed through the resonator is therefore in phase opposition with the part which has passed axially through the resonator, which creates destructive acoustic interference and therefore attenuation of the acoustic pressure.

According to the invention, the acoustic resonator 2 comprises a housing 25 of substantially annular shape. The housing 25 of the acoustic resonator 2 comprises an outer wall and an inner wall 24 defining the annular volume of the acoustic resonator 2. The housing 25 comprises an upstream face corresponding to the inlet of the acoustic resonator 2, located opposite of the downstream face 12 of the fan and a downstream face corresponding to the outlet of the acoustic resonator 2. The outer dimensions of the housing 25 of the acoustic resonator 2 are substantially the same as the outer dimensions of the fan 1. The housing 25 of the acoustic resonator 2 is mounted coaxially on the fan 1. Thus the central zone of the air flow generated by the fan 1 passes axially through the acoustic resonator 2 while the annular zone of the air flow generated by the fan 1 passes into the housing 25 of the acoustic resonator 2.

The acoustic resonator 2 comprises at least one channel 26 following a helical path along the longitudinal axis of the fan 1. Each channel 26 is formed in the interior volume of the acoustic resonator 2 and comprises an inlet 27 and an outlet 28. The inlet 27 of each channel 26 is located opposite the downstream face 12 of the fan 1. It has to be noticed that the housing 25, the fan 1 and the each channel 26 are coaxial.

Each channel 26 is formed in the internal volume of the acoustic resonator 2 by flexible or elastic walls 29 so that it is possible to vary the width of the channel or channels 26 but not the length of the channel or channels 26. Thus, the distance traveled by the acoustic wave in the central zone of the air flow is shorter than the distance traveled by this same acoustic wave in the channel or channels 26 of the acoustic resonator 2. According to the variant shown, the acoustic resonator 2 comprises five channels 26.

According to the invention, the length of the housing 25, that is to say the distance between the upstream face (input of the resonator) and the downstream face (output of the resonator) is variable as a function of the acoustic wave generated by the fan, i.e. according to the fan rotation speed. To generate a phase opposition between the acoustic wave passing through the central zone of the acoustic resonator 2 and the acoustic wave passing through the channel or channels 26 of the acoustic resonator 2, the length l of the acoustic resonator according to the invention is defined by the formula:

$$l = L - \frac{1}{2}\lambda$$

With:

L, the length of the channel or channels 26 of the acoustic resonator

λ, the wavelength of the frequency that we are trying to reduce

For example, if the frequency that one seeks to attenuate is 350 Hz and the length of the channel (s) 26 of the acoustic resonator 2 is set at 65 cm, the variable length of the resonator will be set to 16 cm. If the frequency increases and goes to 400 Hz, the thickness of the resonator will vary to 23 cm.

Figure 3:
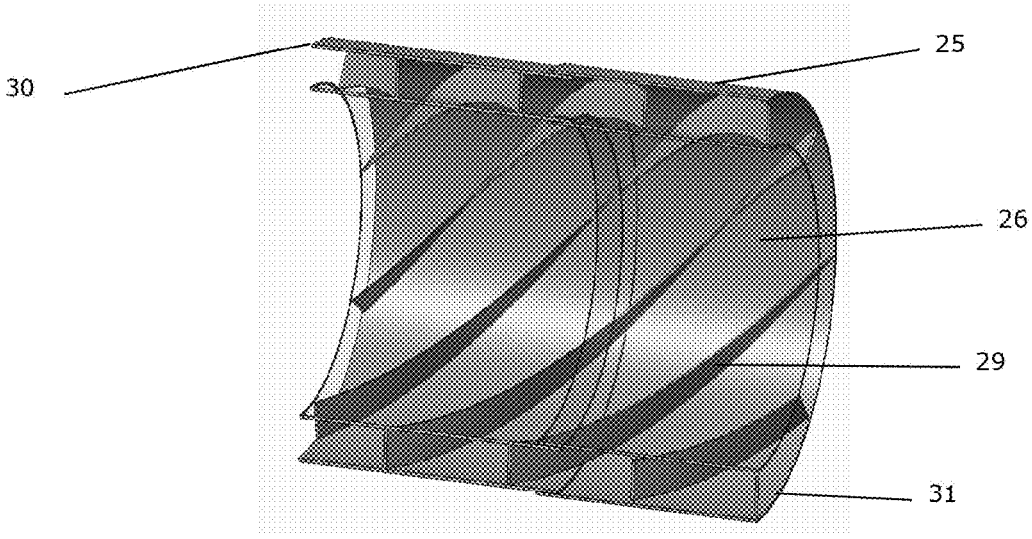
FIG. 3 is a perspective and longitudinal section view of a resonator according to the invention from a first position
Figure 4:
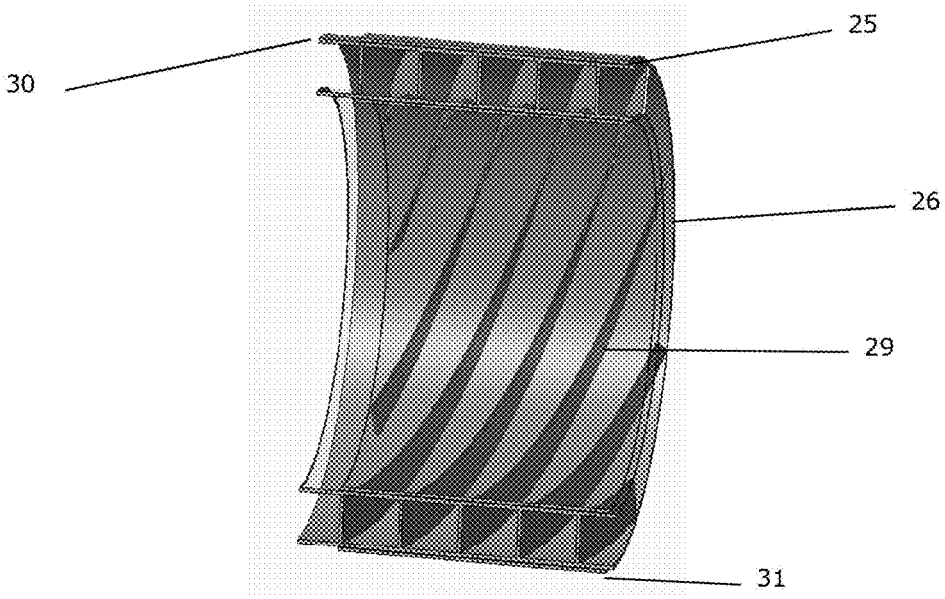
FIG. 4 is a perspective and longitudinal section view of a resonator according to the invention in a second position.

As illustrated in FIGS. 3 and 4, the housing 25 is, for example, formed by at least two annular sections 30, 31 capable of moving axially with respect to one another. The axial displacement then causes a modification of the total length of the housing 25. During the displacement of the annular sections 30, 31 the flexible wall (s) 29 will deform to continue to form the (s)) channel (s) of the acoustic resonator 2 so that the length of the channel (s) 26 remains constant regardless of the length of the housing 26 of the acoustic resonator 2.

According to a first variant embodiment, the annular sections 30, 31 move in translation along the longitudinal axis of the acoustic resonator 2. In other words, the annular sections 30, 31 slide one inside the other in the direction of the longitudinal axis of the acoustic resonator. The movement is for example achieved by simple sliding or through a groove-type guide. The movement is generated by a mechanical actuator (not shown) of the push type or equivalent known per se.

According to a second variant embodiment, the annular sections 30, 31 move in rotation around the longitudinal axis of the acoustic resonator 2 in a helical movement. The movement is generated by a mechanical actuator (not shown) of the known per se electric motor type driving at least one of the annular sections.

In these both embodiments, a sealing element is provided to limit or avoid air leakage between moving annular sections 30, 31. For example, a sealing lips is provided on the edge of flexible wall 29 that move relative to an annular section 30, 31.

It is to be understood that the present invention is not limited to the embodiments described above and illustrated in the drawings; rather, the skilled person will recognize that many changes and modifications may be made within the scope of the appended claims.

The invention claimed is:

1. Acoustic resonator for a fan, the acoustic resonator comprising: a housing defining an internal volume having an annular shape, the housing having an upstream face corresponding to an inlet of the acoustic resonator and a downstream face corresponding to an outlet of the acoustic resonator, the housing and internal volume being coaxial relative to a longitudinal axis of the acoustic resonator, wherein the internal volume comprises at least one coaxial helical channel, the at least one coaxial helical channel comprising an inlet and an outlet corresponding to the inlet and the outlet of the acoustic resonator, and adjusting means provided for modifying a length between the inlet and the outlet of the acoustic resonator according to an acoustic frequency, in order to lower noise.

2. Acoustic resonator for fan according to claim 1 characterized in that each coaxial channel comprises a flexible wall formed between an external and internal wall of the housing.

3. Acoustic resonator for fan according to claim 1 characterized in that adjusting means comprises a upstream section of the housing and a downstream section of the housing, the upstream and downstream section of the housing are arranged to slide one into the other.

4. Acoustic resonator for fan according to claim 3 characterized in the adjusting means comprises an actuator to move upstream and downstream section relative to each other.

5. Acoustic resonator for fan according to claim 3 characterized in that sliding movement of the upstream and downstream section relative to each other is a translation parallel to longitudinal axis of the acoustic resonator.

6. Acoustic resonator for fan according to claim 3 characterized in that sliding movement of the upstream and downstream section relative to each other is a rotation around the longitudinal axis of the acoustic resonator.

7. System for reduction of fan noise comprising a multiple blade impeller mounted on the housing, the housing comprising the acoustic resonator according to claim 1.

* * * * *